US005941306A

United States Patent [19]

Quinn

[11] Patent Number: 5,941,306

[45] Date of Patent: Aug. 24, 1999

[54] RATCHET RELEASE MECHANISM FOR A RETRIEVABLE WELL APPARATUS AND A RETRIEVABLE WELL APPARATUS

[76] Inventor: Desmond Quinn, P.O. Box 23120, Grande Prairie, Canada, T8V 6X2

[21] Appl. No.: 08/946,669

[22] Filed: Oct. 7, 1997

[51] Int. Cl.[6] ..... E21B 33/29

[52] U.S. Cl. ..... 166/120; 166/217

[58] Field of Search ..... 166/120, 123, 166/134, 217

[56] References Cited

U.S. PATENT DOCUMENTS

| | | | |
|---|---|---|---|
| 3,749,166 | 7/1973 | Young | 166/134 X |
| 4,018,272 | 4/1977 | Brown et al. | 166/120 X |
| 4,059,150 | 11/1977 | Manderscheid | 166/120 |
| 4,156,460 | 5/1979 | Crowe | 166/120 |
| 4,289,200 | 9/1981 | Fisher, Jr. . | |
| 4,754,814 | 7/1988 | Jordan, Jr. . | |
| 4,834,175 | 5/1989 | Ross et al. | 166/120 |
| 5,177,906 | 6/1992 | Giusti, Jr. et al. | 166/120 |

FOREIGN PATENT DOCUMENTS 0431689 2/1986 European Pat. Off. .

*Primary Examiner*—Frank Tsay
*Attorney, Agent, or Firm*—Davis and Bujold

[57] ABSTRACT

A ratchet/release mechanism for a retrievable well apparatus and a retrievable well apparatus includes a split ratchet ring engaging threads on a mandrel. Split ring wedge members engage an inclined end of the ratchet ring to maintain the ratchet ring in engagement with the mandrel. The wedge members are prevented from radial outward movement by a sleeve. A resilient elastomer ring is positioned between the ratchet ring and an internal shoulder on the sleeve. The ring compresses to enable the inclined end of the ratchet ring to slide up the wedge members upon movement of the mandrel in a first direction. The release of the ratchet ring is effected by moving the sleeve. When the wedge members are no longer confined by the sleeve they move radially away from the ratchet ring allowing the ratchet ring to disengage from the mandrel.

7 Claims, 3 Drawing Sheets

RATCHET RELEASE MECHANISM FOR A RETRIEVABLE WELL APPARATUS AND A RETRIEVABLE WELL APPARATUS

FIELD OF THE INVENTION

The present invention relates to a ratchet/release mechanism for a retrievable well apparatus which is capable of being set in production tubing and subsequently retrieved and, in particular, a ratchet/release mechanism enabling the retrievable well apparatus to be retrieved on slick line.

BACKGROUND OF THE INVENTION

Retrievable well apparatus have an outer housing and an inner mandrel telescopically received within the outer housing. In order to secure the apparatus within a well, such apparatus have packing elements, gripping slips, or both. Upon relative telescopic movement of the outer housing and the mandrel in a first direction, the packing elements or gripping slips are forced outwardly into engagement with conduit within the well. Upon relative telescopic movement in a second direction, the packing elements or gripping slips retract to enable the retrievable well apparatus to be retrieved from the well. The key component in a retrievable well apparatus is a ratchet/release mechanism that enables relative movement of the housing and the mandrel in the first direction, but prevents relative movement of the housing and the mandrel in the second direction until intentionally released.

U.S. Pat. No. 4,289,200 which issued in 1981 discloses a retrievable well apparatus developed by Baker International Corporation. The key components in the ratchet/release mechanism of the Baker apparatus include a housing, a locking ring which can be radially inwardly constricted, two diametrically opposed segments, a mandrel and a movable sleeve. The housing has an inner wall with a series of fine pitched axially spaced teeth which are configured to provide an inclined plane which permits movement in only the first direction. The teeth on the inner wall of the housing engage similar teeth on an outer cylindrical surface of a lock ring. The lock ring has an axial slot to permit radially inward constriction. The lock ring also has teeth on an inner cylindrical surface. The teeth on the inner cylindrical surface of the lock ring engage similar teeth on an outer cylindrical surface of the pair of diametrically opposed segments. The segments engage axial slots in the mandrel. The segments are radially inwardly movable in the slots by a sufficient amount to release the threads on the outer cylindrical surface of the segments from engagement with the threads on the inner cylindrical surface of the lock ring. The sleeve is axially movable along the mandrel. When the sleeve is positioned behind the segments, it holds the segments out maintaining them in engagement with the lock ring. The sleeve is retained in position by shear pins. When a retrievable well apparatus is to be retrieved, sleeve is engaged by threaded engagement with a retrieval tool. A force is then exerted to shear the shear pins enabling the sleeve to be moved axially along the mandrel. Once the sleeve is moved out of the way, the segments are able to move inwardly further into the slots and out of engagement with the teeth of the locking ring.

European Patent Specification 431,689 published in 1995 discloses a retrievable well apparatus developed by Dowell Schlumberger. The key components in the ratchet/release mechanism include a ratchet sleeve that can be collapsed radially inwardly, a split ratchet ring, a two part telescopic housing held in a set position by shear pins, and a mandrel with axial recesses. The ratchet sleeve is mounted on the mandrel. The ratchet sleeve has slotted ratchet finger elements that can be collapsed radially inwardly. The finger elements have external threads. The split ratchet ring is T shaped. The T shape enables the elements of the ratchet ring to be retained within recesses in the housing. The ratchet ring elements have cooperating internal threads that engage the external threads on the ratchet sleeve. As the mandrel moves in the first direction, it forces the split ratchet ring to expand outwardly to provide ratcheting as sleeve slides during setting. The teeth of the ratchet fingers on the ratchet sleeve are held in engagement with the teeth of the split ratchet ring due to presence of the mandrel. In order to release ratchet/release mechanism, the housing is threadedly engaged and a force exerted upon it to shear the shear pins, thereby allowing a portion of the housing to telescope. The telescoping portion of the housing has an inwardly projecting portion which cams against the ratchet fingers of the ratchet sleeve. Mandrel has a reduced outer diameter portion into which the ratchet fingers are pushed by this camming action. Once the ratchet fingers have been pushed sufficiently inwardly they disengage from the trapping threads on the split ratchet ring.

The Baker ratchet/release mechanism and the Dowell Schlumberger ratchet/release mechanism described above were developed for positioning between production tubing of a well and well casing. In this environment the smallest outer diameter that one would work with would be 4½ inches. In this environment the normal manner of connection is a threaded connection. In this environment the force required to trigger the release of the ratchet/release mechanism is typically in the range of 30,000 to 50,000 pounds.

Their are applications in the oil and gas industry in which it would be advantageous to have a retrievable well apparatus that could be retrieved by slick line. Such application generally involve setting tools within the production tubing. The ratchet/release mechanisms described above cannot be used for such applications. There are practical limits as to the extent to which the described ratchet/release mechanisms can be miniaturized. There are also limits that are inherent in the use of a slick line. The major limitation relating to the force required to release the ratchet/release mechanism. A slick line is only capable of safely applying a release force in the magnitude of 1000 to 2000 pounds.

SUMMARY OF THE INVENTION

What is required is a ratchet/release mechanism for a retrievable well apparatus that is capable of being set in production tubing and subsequently released by slick line.

According to the present invention there is provided a ratchet/release mechanism for a retrievable well apparatus of the type having a tubular outer housing, an inner mandrel telescopically received within the outer housing, and gripping means that are forced radially outwardly from the housing upon relative telescopic movement of the outer housing and the mandrel in a first direction. The ratchet/release mechanism includes an outer housing having a first portion and a second portion in end to end relation. A sleeve is provided having a first end and a second end. The first end of the sleeve is secured to the first portion of the outer housing. The second end is telescopically received in the second portion of the outer housing. The sleeve is movable between an extended position and a retracted position. Stop means are provided between the second end of the sleeve and the second portion of the outer housing, whereby the second end of the sleeve is prevented from being withdrawn from the second portion of the outer housing when in the extended position. Means is provided for maintaining the sleeve in the retracted position until a predetermined axial release force is exerted. Threads are provided on an outer surface of the mandrel. A split ratchet ring is positioned around the outer surface of the mandrel within the sleeve. The ratchet ring has an interior surface with threads that engage the threads on the outer surface of the mandrel. The ratchet ring has an interior surface, an exterior surface, a first end and a second end. The second end is remote from the first portion of the housing and inclined from the exterior surface inwardly toward the interior surface. A plurality of split ring wedge members engage the inclined second end of the split ratchet ring to maintain the threads of the split ratchet ring in engagement with the threads of the mandrel. The split wedge member is prevented from radial outward movement by the sleeve. Biasing means are positioned between the first end of the ratchet ring and an internal shoulder on the sleeve. The biasing means compress to enable the inclined second end of the ratchet ring to slide up the wedge members upon movement of the mandrel in the first direction. This enables the threads on the interior surface of the ratchet ring to be temporarily disengaged from the threads on the outer surface of the mandrel. The release of the ratchet ring from engagement with the mandrel is effected by hooking onto the first portion of the outer housing and applying an upward axial force to release the means maintaining the sleeve in the retracted position. This enables the sleeve to move to the extended position. With the sleeve in the extended position the wedge members are no longer confined by the sleeve and move away from the ratchet ring allowing the threads on the interior surface of the ratchet ring to disengage from the threads on the outer surface of the mandrel, thereby permitted relative movement of the outer housing and the mandrel in the second direction.

The ratchet/release mechanism, as described above, far more sensitive than the ratchet/release mechanisms of the prior art. Were it not for the presence of the shear pins or similar means securing the sleeve in the retracted position, a pull of as little as 10 pounds could be used to release the mechanism. Of course, it is undesirable for such a small force to be able to effect a release of the mechanism, so shear pins are selected that are within the desired range of 1000 to 2000 pounds enabling the ratchet/release mechanism to be released by a slick line or coil tubing. There are a variety of ways of setting the ratchet/release mechanism which will not be described in this application. Beneficial results have been achieved by setting the ratchet/release mechanism using an explosive charge, although it can also be set hydraulically or with coil tubing.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
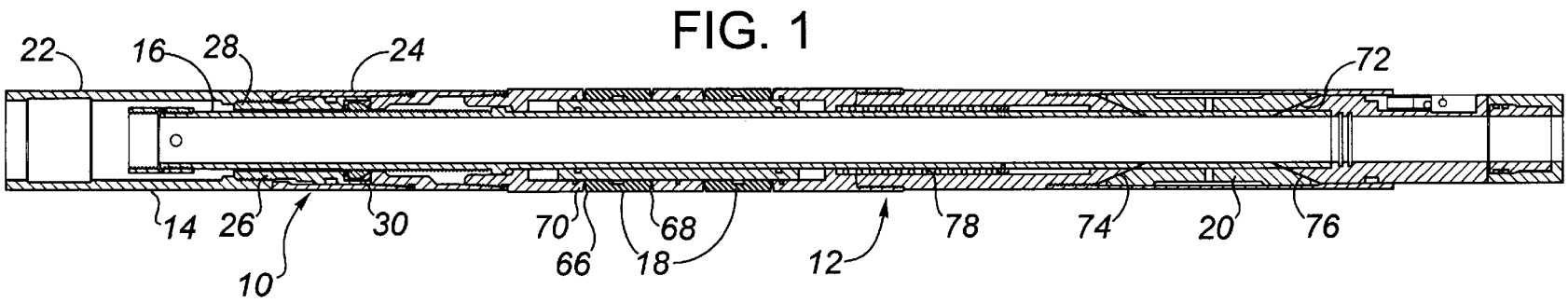
FIG. 1 is a side elevation view, in section, of a retrievable well apparatus having a ratchet/release mechanism constructed in accordance with the teachings of the present invention.

The preferred embodiment, a ratchet/release mechanism generally identified by reference numeral 10, will now be described with reference to FIGS. 1 through 7.

Figure 2:
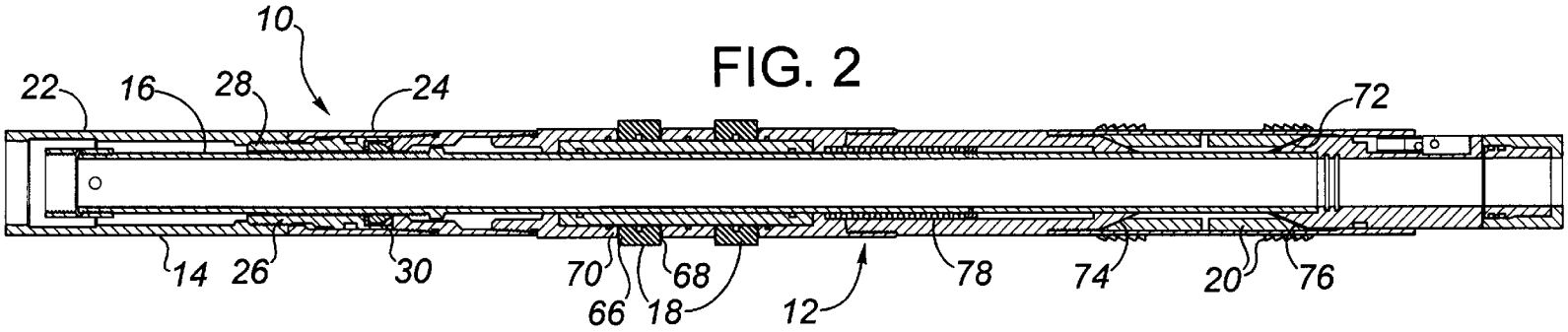
FIG. 2 is a side elevation view, in section, of the retrievable well apparatus illustrated in FIG. 1, with the ratchet/release mechanism set.
Figure 3:
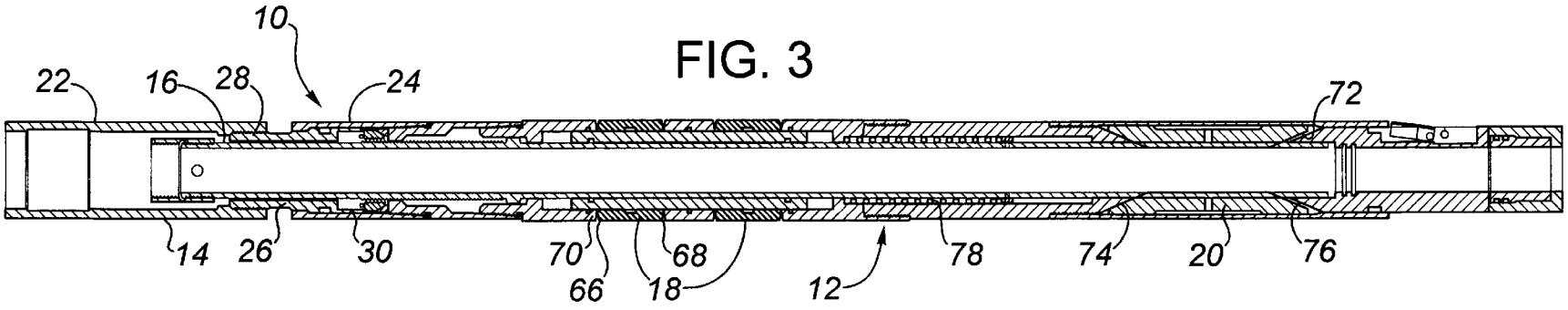
FIG. 3 is a side elevation view, in section, of the retrievable well apparatus illustrated in FIG. 1, with the ratchet/release mechanism released.

Referring to FIGS. 1 through 3, ratchet/release mechanism 10 is intended for incorporation in a retrievable well apparatus, generally indicated by reference numeral 12. Retrievable well apparatus 12 includes a tubular outer housing 14 and an inner mandrel 16 that is telescopically received within outer housing 14. Two types of gripping means are illustrated; an elastomer packing element 18 and gripping slips 20, which will hereinafter be further described. Both packing element 18 and gripping slips 20 are forced radially outwardly from housing 14 upon relative telescopic movement of outer housing 14 and mandrel 16 in a first direction.

Figure 4:
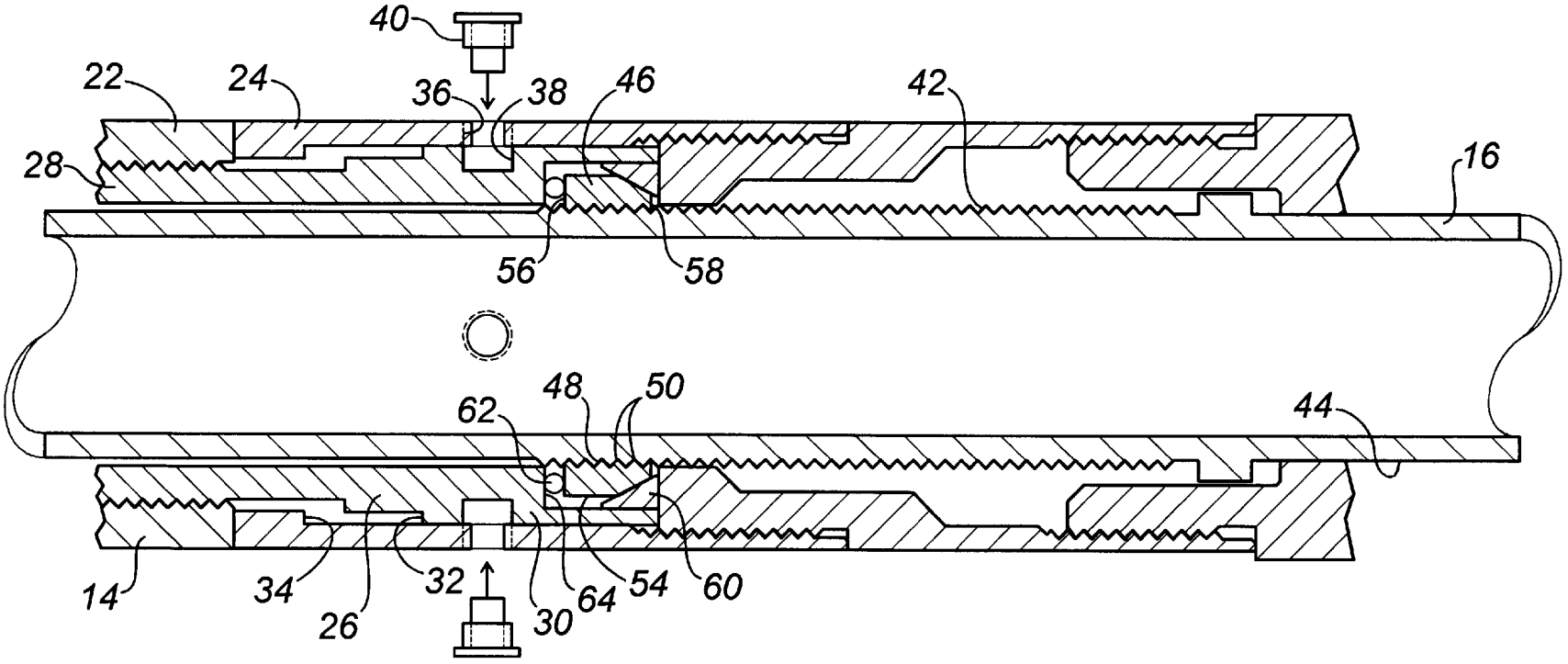
FIG. 4 is a detailed side elevation, in section, of the ratchet/release mechanism from the retrievable well apparatus illustrated in FIG. 1.
Figure 5:
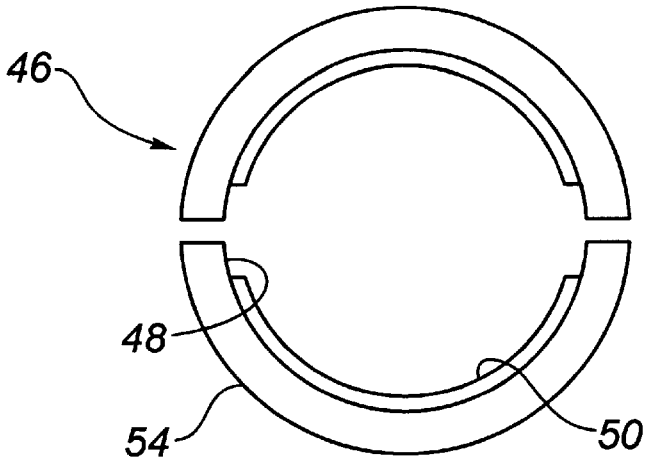
FIG. 5 is a top plan view of a split ratchet ring from the ratchet/release mechanism illustrated in FIG. 4.
Figure 7:
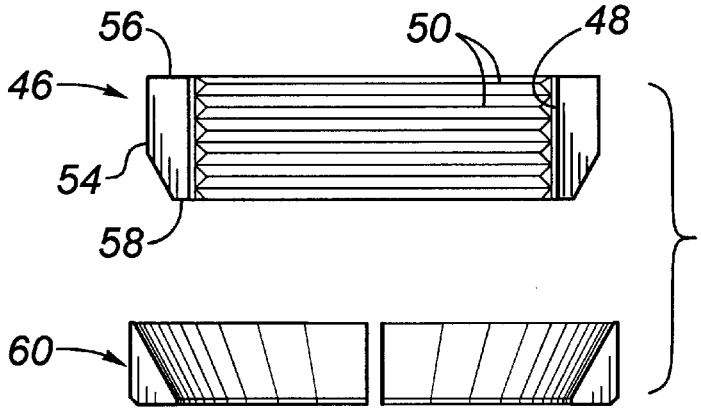
FIG. 7 is an exploded side elevation view of a split wedge members from the ratchet/release mechanism illustrated in FIG. 4.

Ratchet/release mechanism 10 works cooperatively with outer housing 14 and inner mandrel 16. Outer housing 14 has a first portion 22 and a second portion 24 arranged in end to end relation. A sleeve 26 is provided which as a first end 28 and a second end 30. First end 28 of sleeve 26 is secured to first portion 22 of outer housing 14. Second end 30 of sleeve 26 is telescopically received in second portion 24 of outer housing 14. Sleeve 26 is telescopically movable in relation to second portion 24 of outer housing 14 between an extended position illustrated in FIG. 3 and a retracted position illustrated in FIGS. 1 and 2. Referring to FIG. 4, an external shoulder 32 on sleeve 26 and an internal shoulder 34 on second portion 24 of outer housing 14 serve as stop means between second end 30 of sleeve 26 and second portion 24 of outer housing 14. Referring to FIG. 3, the travel of sleeve 26 in the extended position is limited by the engagement of external shoulder 32 with internal shoulder 34. This prevents sleeve 26 from being withdrawn from second portion 24 of outer housing 14. Referring to FIG. 4, apertures 36 and 38 in second portion 24 of outer housing 14 and sleeve 26, respectively, receive shear pins 40. When apertures 36 and 38 are axially aligned with shear pins 40 inserted, this serves as means for maintaining sleeve 26 in the retracted position until a predetermined axial release force is exerted which is sufficient to shear pins 40. Ratchet threads 42 are positioned on an outer surface 44 of mandrel 16. A split ratchet ring 46 is positioned around outer surface 44 of mandrel 16, within the confines of sleeve 26. Referring to FIGS. 5 and 7, ratchet ring 46 has an interior surface 48 with threads 50 that engage threads 42 on outer surface 44 of mandrel 16. Threads 42 and 50 have a slope which ensures thread disengagement when desired. The thread has an angle of approximately 45 degrees. This angle of thread, when loaded, has equal forces radially and longitudinally, which forces the split ratch ring 46 to release from outer surface 44 of mandrel 16. Ratchet ring 46 has an interior surface 52, an exterior surface 54, a first end 56 and a second end 58. Referring to FIG. 4, when positioned one mandrel 16, second end 58 is remote from first portion 22 of housing 14. Referring to FIG. 7, second end 58 is inclined from exterior surface 54 inwardly toward interior surface 52.

Figure 6:
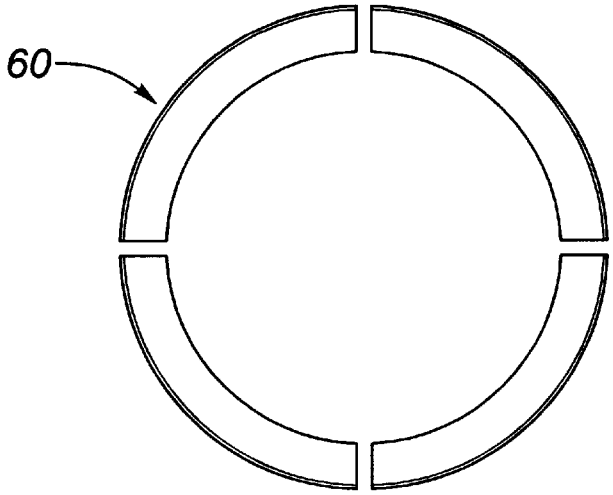
FIG. 6 is a top plan view of a split wedge members from the ratchet/release mechanism illustrated in FIG. 4.

Referring to FIG. 4, a plurality of split ring wedge members 60 engage inclined second end 58 of ratchet ring 46 to maintain threads 42 of ratchet ring 46 in engagement with threads 42 of mandrel 16. Split wedge members 60 are prevented from radial outward movement by sleeve 26. Split wedge members 60 are illustrated in FIGS. 6 and 7. A resilient elastomer ring 62 is used as a biasing means. Elastomer ring 62 is positioned between first end 56 of ratchet ring 46 and an internal shoulder 64 on sleeve 26.

The use and operation of ratchet/release mechanism 10 will now be described in relation to FIGS. 1 through 7. Elastomer ring 62 compresses to enable inclined second end 58 of ratchet ring 46 to slide up wedge members 60 upon movement of mandrel 16 in the first direction. When ratch ring 46 slide up wedge members 60, threads 50 on interior surface 52 of ratchet ring 46 are temporarily disengaged from threads 42 on outer surface 44 of mandrel 16. Referring to FIGS. 1 and 2, the release of ratchet ring 46 from engagement with mandrel 16 is effected by hooking onto first portion 22 of outer housing 14 and applying an upward axial force to shear pins 40 which are the only thing maintaining sleeve 26 in the retracted position. Once shear pins 40 are sheared sleeve 26 is able to move to the extended position, illustrated in FIG. 3. With sleeve 26 in the extended position, wedge members 60 are no longer confined by sleeve 26 and move radially away from ratchet ring 46 allowing threads 50 on interior surface 52 of ratchet ring 46 to disengage from threads 42 on outer surface 44 of mandrel 16. This frees outer housing 14 and mandrel 16 for relative movement in the second direction.

The further features of retrievable well apparatus 12 will now be described. Referring to FIG. 1, each of annular elastomer packing elements 18 have a first edge 66 and a second edge 68. First edge 66 is positioned against a shoulder 70 on outer housing 14. Second edge 68 is secured to inner mandrel 16. Referring to FIG. 2, upon relative movement of outer housing 14 and inner mandrel 16 in the first direction second edge 68 of each of elastomer packing elements 18 can travel with inner mandrel 16. First edge 66 of each of elastomer packing elements 18 is precluded from movement by shoulder 70. This results in elastomer packing elements 18 being compressed and forced radially outwardly from outer housing 14. Referring to FIG. 1, gripping slips 20 have rearwardly positioned contact surfaces 72 which are inclined outwardly from inner mandrel 16 toward outer housing 14. Gripping slips 20 are positioned between a first wedge 74 on outer housing 14 and a second wedge 76 on inner mandrel 16. Referring to FIG. 2, upon relative movement of outer housing 14 and inner mandrel 16 in the first direction first wedge 74 and second wedge 76 slide along inclined contact surfaces 72 of gripping slips 20. Gripping slips 20 are forced radially outwardly from outer housing 14 as first wedge 74 and second wedge 76 move toward each other. In order to prevent partial resetting during retrieval, retrievable well apparatus 12 has a large coil spring 78 serving as biasing means disposed between a shoulder 80 on outer housing 14 and a shoulder 82 on inner mandrel 16. Spring 78 urges relative movement of outer housing 14 and inner mandrel 16 in the second direction.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A ratchet/release mechanism for a retrievable well apparatus having a tubular outer housing, an inner mandrel telescopically received within the outer housing, and gripping means that are forced radially outwardly from the housing upon relative telescopic movement of the outer housing and the mandrel in a first direction, the ratchet/release mechanism comprising:

the outer housing having a first portion and a second portion in end to end relation;

a sleeve having a first end and a second end, the first end being secured to the first portion of the outer housing and the second end being telescopically received in the second portion of the outer housing, the sleeve being movable between an extended position and a retracted position;

stop means between the second end of the sleeve and the second portion of the outer housing, whereby the second end of the sleeve is prevented from being withdrawn from the second portion of the outer housing when in the extended position;

means for maintaining the sleeve in the retracted position until a predetermined axial release force is exerted;

threads on an outer surface of the mandrel;

a split ratchet ring around the outer surface of the mandrel within the sleeve, the ratchet ring having an interior surface with threads that engage the threads on the outer surface of the mandrel, the ratchet ring having an interior surface, an exterior surface, a first end and a second end, the second end being remote from the first portion of the housing and being inclined from the exterior surface inwardly toward the interior surface;

a plurality of split ring wedge members engaging the inclined second end of the split ratchet ring to maintain the threads of the split ratchet ring in engagement with the threads of the mandrel, the split wedge member being prevented from radial outward movement by the sleeve;

biasing means positioned between the first end of the ratchet ring and an internal shoulder on the sleeve, the biasing means compressing to enable the inclined second end of the ratchet ring to slide up the wedge members upon movement of the mandrel in the first direction, whereby the threads on the interior surface of the ratchet ring are temporarily disengaged from the threads on the outer surface of the mandrel;

the release of the ratchet ring from engagement with the mandrel being effected by hooking onto the first portion of the outer housing and applying an upward axial force to release the means maintaining the sleeve in the retracted position, thereby enabling the sleeve to move to the extended position, with the sleeve in the extended position the wedge members are no longer confined by the sleeve and move away from the ratchet ring allowing the threads on the interior surface of the ratchet ring to disengage from the threads on the outer surface of the mandrel, thereby permitted relative movement of the outer housing and the mandrel in the second direction.

2. The ratchet/release mechanism as defined in claim 1, wherein the means for maintaining the sleeve in the retracted position until a predetermined axial release force is exerted include shear pins extending through the outer housing into the sleeve.

3. The ratchet/release mechanism as defined in claim 1, wherein the biasing means positioned between the first end of the ratchet ring and an internal shoulder on the sleeve is a resilient elastomer ring.

4. A retrievable well apparatus, comprising:

a tubular outer housing having a first portion and a second portion in end to end relation;

a sleeve having a first end and a second end, the first end being secured to the first portion of the outer housing and the second end being telescopically received in the second portion of the outer housing, the sleeve being movable between an extended position and a retracted position;

stop means between the second end of the sleeve and the second portion of the outer housing, whereby the second end of the sleeve is prevented from being withdrawn from the second portion of the outer housing when in the extended position;

means for maintaining the sleeve in the retracted position until a predetermined axial release force is exerted;

an inner mandrel telescopically received within the outer housing, the mandrel having an outer surface with ratchet threads;

gripping means that are forced radially outwardly from the housing upon relative telescopic movement of the outer housing and the mandrel in a first direction;

a split ratchet ring around the outer surface of the mandrel within the sleeve, the ratchet ring having an interior surface with threads that engage the threads on the outer surface of the mandrel, the threads on the mandrel and the threads on the ratchet ring being configured to permit movement of the ratchet ring along the mandrel in the first direction and resist movement in a second direction, the ratchet ring having an interior surface, an exterior surface, a first end and a second end, the second end being remote from the first portion of the housing and being inclined from the exterior surface inwardly toward the interior surface;

a plurality of split ring wedge members engaging the inclined second end of the split ratchet ring to maintain the threads of the split ratchet ring in engagement with the threads of the mandrel, the split wedge member being prevented from radial outward movement by the sleeve;

biasing means positioned between the first end of the ratchet ring and an internal shoulder on the sleeve, the biasing means compressing to enable the inclined second end of the ratchet ring to slide up the wedge members upon movement of the mandrel in the first direction, whereby the threads on the interior surface of the ratchet ring are temporarily disengaged from the threads on the outer surface of the mandrel;

the release of the ratchet ring from engagement with the mandrel being effected by hooking onto the first portion of the outer housing and applying an upward axial force to release the means maintaining the sleeve in the retracted position, thereby enabling the sleeve to move to the extended position, with the sleeve in the extended position the wedge members are no longer confined by the sleeve and move away from the ratchet ring allowing the threads on the interior surface of the ratchet ring to disengage from the threads on the outer surface of the mandrel, thereby permitted relative movement of the outer housing and the mandrel in the second direction.

5. The retrievable well apparatus as defined in claim 4, wherein the gripping means includes annular elastomer packing elements having a first edge and a second edge, first edge is positioned against a first shoulder on the outer housing, second edge is secured to the inner mandrel, such that upon relative movement of the outer housing and the inner mandrel in the first direction the elastomer packing elements are compressed as the second edge travels with the inner mandrel toward the first edge and are forced radially outwardly from the outer housing.

6. The retrievable well apparatus as defined in claim 4, wherein the gripping means includes gripping slips with rear contact surfaces inclined outwardly from the inner mandrel toward the outer housing, the gripping slips being positioned between a first wedge on the outer housing and a second wedge on the inner mandrel, such that upon relative movement of the outer housing and the inner mandrel in the first direction the first wedge and the second wedge slide along the inclined contact surfaces of the gripping slips, forcing the gripping slips radially outwardly from the outer housing as the first wedge and the second wedge move toward each other.

7. The retrievable well apparatus as defined in claim 4, wherein biasing means are disposed between a shoulder on the outer housing and a shoulder on the inner mandrel, the biasing means urging relative movement of the outer housing and the inner mandrel in the second direction.

* * * * *